US008599074B2

(12) United States Patent
Wong et al.

(10) Patent No.: US 8,599,074 B2
(45) Date of Patent: Dec. 3, 2013

(54) MOBILE COMMUNICATION DEVICE AND ANTENNA THEREOF

(75) Inventors: Kin-Lu Wong, Taipei Hsien (TW); Cheng-Tse Lee, Taipei Hsien (TW)

(73) Assignee: Acer Inc., Taipei Hsien (TW)

( * ) Notice: Subject to any disclaimer, the term of this patent is extended or adjusted under 35 U.S.C. 154(b) by 271 days.

(21) Appl. No.: 12/648,365

(22) Filed: Dec. 29, 2009

(65) Prior Publication Data

US 2011/0084883 A1 Apr. 14, 2011

(30) Foreign Application Priority Data

Oct. 8, 2009 (TW) ..... 98134200 A

(51) Int. Cl.
*H01Q 1/24* (2006.01)

(52) U.S. Cl.
USPC ..... 343/702

(58) Field of Classification Search
USPC ..... 343/700 MS, 702, 846
See application file for complete search history.

(56) References Cited

U.S. PATENT DOCUMENTS

2008/0180333 A1* 7/2008 Martiskainen et al. ..... 343/722
2009/0189815 A1* 7/2009 Hotta et al. ..... 343/700 MS

FOREIGN PATENT DOCUMENTS

TW 227576 2/2005

OTHER PUBLICATIONS

Chih-Hua Chang and Kin-Lu Wong, "Penta-Band One-Eight Wavelength PIFA for Internal Mobile Phone Antenna"—Antennas and Propagation Society International Symposium, Jun. 1-5, 2009. 4 pgs. IEEE.

* cited by examiner

*Primary Examiner* — Robert Karacsony
(74) *Attorney, Agent, or Firm* — Alan Kamrath; Kamrath IP Lawfirm, P.A.

(57) ABSTRACT

A mobile communication device has a ground plane and an antenna. The antenna is disposed on a dielectric substrate and includes a radiating metal portion, a coupling metal portion, and a shorting metal portion. One edge of the radiating metal portion faces the ground plane and has a distance between the edge and the ground plane. The coupling metal portion is electrically connected to a source via a connecting metal strip. One end of the shorting metal portion is electrically connected to the radiating metal portion, and the other end of the shorting metal portion is electrically connected to the ground plane.

7 Claims, 5 Drawing Sheets

MOBILE COMMUNICATION DEVICE AND ANTENNA THEREOF

BACKGROUND OF THE INVENTION

1. Field of the Invention

The present invention relates to a mobile communication device. More particularly, the present invention relates to a mobile communication device having a multi-band antenna.

2. Description of the Related Art

With the vigorous development of mobile communication industries, products for mobile communication devices have become very diverse, with mobile phones being the most popular among all these products. Nowadays, the essential requirements of a mobile phone include not only a communication function but also a multimedia application and transmission function. For example, a user may utilize an internet access function of a mobile phone to obtain real-time information, take care of important documents, or enjoy video/audio entertainment. Most of the services provided by a mobile phone are achieved by wireless communication transmission. Therefore, an antenna is an important key element in the design of a multimedia mobile phone.

In order to achieve a variety of different wireless applications, it has become a trend to develop a multi-band antenna for a mobile phone. This means that the antenna for the mobile phone should be capable of performing multi-band operations at the same time. Generally, most mobile phone antennas are designed as inverted-F antennas commonly implemented to achieve multi-band or wide-band operations by utilizing multiple resonant paths to generate multiple resonant modes. For example, Taiwan Patent No. 1227576 (Dual-band inverted-F antenna with a shorted parasitic element) discloses an antenna to achieve multi-band operations by utilizing multiple resonant paths to generate multiple resonant modes. However, the operating bandwidth of the antenna is still very limited and cannot meet 8-band operations required by current wireless communication technology such as long term evolution (LTE) and wireless wide area network (WWAN). The 8-band operations include 3 low-frequency bands for the LTE700/GSM850/900 (698~960 MHz) operations and 5 high-frequency bands for the GSM1800/1900/UMTS/LTE2300/LTE2500 (1710~2690 MHz) operations. Further, if there is a need to utilize more resonant paths to achieve the wide-band or multi-band operations, the physical size of the antenna would be too big to fit in a modern mobile phone.

Therefore, it is necessary to provide a mobile communication device and antenna thereof to overcome the deficiency encountered by the prior art techniques.

SUMMARY OF THE INVENTION

It is an object of the present invention to provide a mobile communication device having an antenna of a small size and capable of respectively generating wide operating bandwidths at both a low-frequency band and a high-frequency band by utilizing a wide radiating metal portion, to achieve a dual-band characteristic as well as to meet 8-band LTE/WWAN operations.

It is another object of the present invention to provide an antenna of a small size and capable of respectively generating wide operating bandwidths at both a low-frequency band and a high-frequency band by utilizing a wide radiating metal portion, to achieve a dual-band characteristic as well as to meet 8-band LTE/WWAN operations.

To achieve the abovementioned objects, the mobile communication device of the present invention has a ground plane and an antenna. The antenna is disposed on a dielectric substrate. The antenna includes a radiating metal portion having a width and a length, with the width being at least one-eighth of the length. One edge of the radiating metal portion faces the ground plane and has a distance between the edge and the ground plane and has a shorting point. The radiating metal portion passes through a central line defined according to the center of the length, and the distance between the shorting point and the central line of the radiating metal portion is less than 15 min. A coupling metal portion, which couples electromagnetic energy to the radiating metal portion via a coupling gap, is electrically connected to a source via a connecting metal strip, and the distance between the connecting metal strip and the central line of the radiating metal portion is less than 15 mm. A shorting metal portion, with one end electrically connected to the radiating metal portion and the other end electrically connected to the ground plane, has a chip inductor. The length of the shorting metal portion is at least 2 times the distance between the radiating metal portion and the ground plane.

To achieve the abovementioned objects, the antenna of the present invention comprises: a radiating metal portion having a width and a length, with the width being at least one-eighth of the length. One edge of the radiating metal portion faces the ground plane and has a distance between the edge and the ground plane and has a shorting point. The radiating metal portion passes through a central line defined according to the center of the length, and the distance between the shorting point and the central line of the radiating metal portion is less than 15 mm. A coupling metal portion, which couples electromagnetic energy to the radiating metal portion via a coupling gap, is electrically connected to a source via a connecting metal strip, and the distance between the connecting metal strip and the central line of the radiating metal portion is less than 15 mm. A shorting metal portion, with one end electrically connected to the radiating metal portion and the other end electrically connected to the ground plane, has a chip inductor. The length of the shorting metal portion is at least 2 times the distance between the radiating metal portion and the ground plane.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, similar reference numerals denote similar elements throughout the several views.

DETAILED DESCRIPTION OF THE PREFERRED EMBODIMENTS

Figure 1:
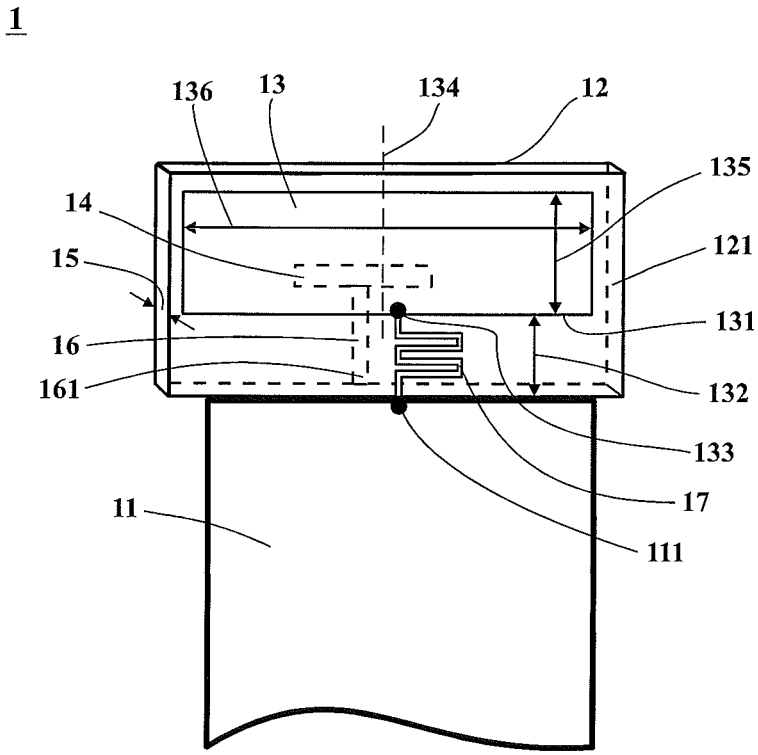
FIG. 1 illustrates a structural view of a mobile communication device in a first embodiment of the present invention.

FIG. 1 illustrates a structural view of a mobile communication device in a first embodiment of the present invention. The mobile communication device 1 has a ground plane 11 and an antenna 12. The antenna 12 is disposed on a dielectric substrate 121. For example, the antenna 12 is formed on the dielectric substrate 121 by etching or printing. The antenna 12 comprises a radiating metal portion 13, a coupling metal portion 14 and a shorting metal portion 17.

In this embodiment, the radiating metal portion 13 is rectangular in shape, and it has a width 135 and a length 136. The width 135 is at least one-eighth of the length 136. When the width 135 is less than one-eighth of the length 136, the operating bandwidth of the antenna 12 will be significantly decreased without meeting the requirements of at least 270 MHz for the low-frequency band and at least 1 GHz for the high-frequency band.

One edge 131 of the radiating metal portion 13 faces the ground plane 11. This edge 131 is closer to the edge of the ground plane 11 among all four edges of the radiating metal portion 13. There is a distance 132 between the edge 131 and the ground plane 11. The edge 131 has a shorting point 133, and the distance between the shorting point 133 and a central line 134 of the radiating metal portion 13 is less than 15 mm, and preferably, the shorter the better. Considering that a general mobile communication device such as a mobile phone is at least 40 mm in width, the condition of the distance could have the shorting point 133 approximately positioned close to the central line 134 of the radiating metal portion 13.

The coupling metal portion 14 couples electromagnetic energy to the radiating metal portion 13 via a coupling gap 15; i.e., the thickness of the dielectric substrate 121. The coupling metal portion 14 is electrically connected to a connecting metal strip 16, and one end 161 of the connecting metal strip 16 is electrically connected to a source (not shown in FIG. 1). The distance between the side of the connecting metal strip 16 and the central line 134 of the radiating metal portion 13 is less than 15 mm, and preferably, the shorter the better.

One end of the shorting metal portion 17 is electrically connected to the shorting point 133 of the radiating metal portion 13, while the other end of the shorting metal portion 17 is connected to a ground point 111 of the ground plane 11. In this embodiment, the length of the shorting metal portion 17 is at least 2 times the distance 132 between the radiating metal portion 13 and the ground plane 11.

If the line width of the shorting metal portion 17 is made thinner, its length can be shortened accordingly. However, please note that the length of the shorting metal portion 17 is still preferably at least 2 times the distance 132 between the radiating metal portion 13 and the ground plane 11 to provide sufficient inductance for the input impedance of the antenna. Basically, the line width of the shorting metal portion 17 has to be less than 1 mm. If the line width of the shorting metal portion 17 is greater than 1 mm, the shorting metal portion 17 is unable to provide sufficient inductance for the input impedance of the antenna.

Figure 2:
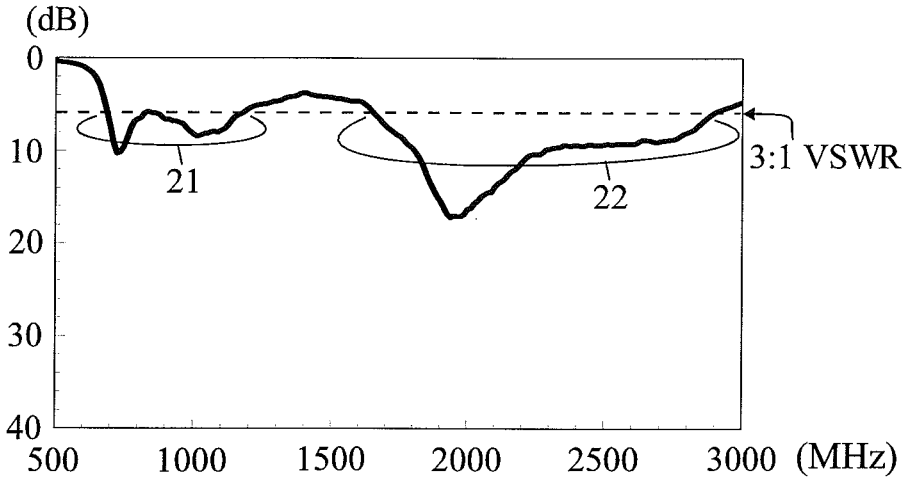
FIG. 2 illustrates a diagram of a measured return loss of the mobile communication device in the first embodiment of the present invention.

FIG. 2 illustrates a diagram of a measured return loss of the mobile communication device in the first embodiment of the present invention. The horizontal axis represents the operating frequency, and the vertical axis represents the return loss. In the first embodiment, the ground plane 11 is about 100 mm in length and 40 mm in width, and the surface area of the antenna 12 is about 20×40 $mm^2$. The antenna 12 is disposed on a dielectric substrate 121 with its thickness of about 0.8 mm. The radiating metal portion 13 is about 40 mm in length and 10 mm in width. The width is about one-fourth of the length. There is a distance 132 of about 8 mm between the edge 131 of the radiating metal portion 13 and the ground plane 11, and the distance between the shorting point 133 of the edge 131 and the central line 134 of the radiating metal portion 13 is about 1.0 mm. The coupling metal portion 14 is about 12 mm in length and 1.5 mm in width. The connecting metal strip 16 is about 8 mm in length and 1.5 mm in width, and the distance between the connecting metal strip 16 and the central line 134 of the radiating metal portion 13 is about 2 mm. The shorting metal portion 17 is about 31 mm in length and 0.4 mm in width, and the length of the shorting metal portion 17 is about 4 times the distance 132 between the radiating metal portion 13 and the ground plane 11. Both the distance between the shorting point 133 and the central line 134 of the radiating metal portion 13 and the distance between the connecting metal strip 16 and the central line 134 of the radiating metal portion 13 are less than 15 mm. Accordingly, sufficient inductance for the input impedance of the antenna 12 can be provided by utilizing the radiating metal portion 13 with a wider width (which is at least one-eighth of its length) and the shorting metal portion 17, such that the antenna 12 is capable of generating a wide low-frequency band.

From the experimental results, with the definition of 6-dB return loss (according to mobile communication device antenna design guidelines), the mobile communication device of the present invention has a first operating band 21 capable of covering the 3-band LTE700/GSM850/900 (698~960 MHz) operations and a second operating band 22 capable of covering the 5-band GSM1800/1900/UMTS/LTE2300/LTE2500 (1710~2690 MHz) operations. Therefore, the mobile communication device of the present invention is capable of covering the 8-band operations.

Figure 3:
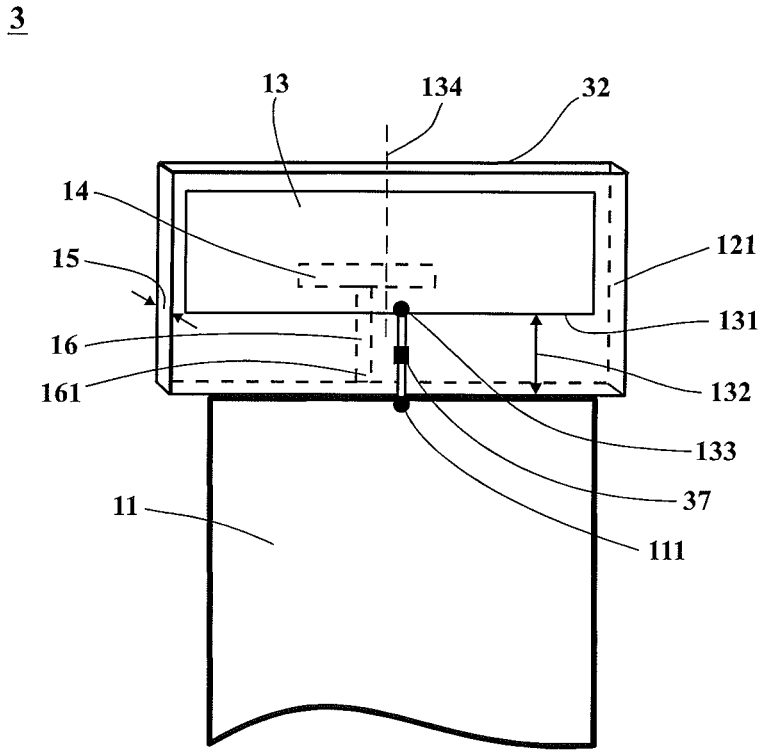
FIG. 3 illustrates a structural view of a mobile communication device in a second embodiment of the present invention.

FIG. 3 illustrates a structural view of a mobile communication device in a second embodiment of the present invention. The mobile communication device 3 has a ground plane 11 and an antenna 32. The antenna 32 is disposed on a dielectric substrate 121. The antenna 32 comprises a radiating metal portion 13, a coupling metal portion 14, and a shorting metal portion 37.

The shorting metal portion 37 has a chip inductor. In this embodiment, the inductance of the chip inductor is about 8 nH. Except for the shorting metal portion 37, other elements disclosed in the second embodiment are similar to those disclosed in the first embodiment. Because the chip inductor can provide sufficient inductance for the input impedance of the antenna 32, adequate inductance of the chip inductor can effectively shorten the length of the shorting metal portion 37. In this embodiment, the shorting metal portion 37 is in the shape of a straight line, whose length can be the same as the distance 132 between the radiating metal portion 13 and the ground plane 11. Therefore, the second embodiment can achieve results similar to those which the first embodiment does.

Figure 4:
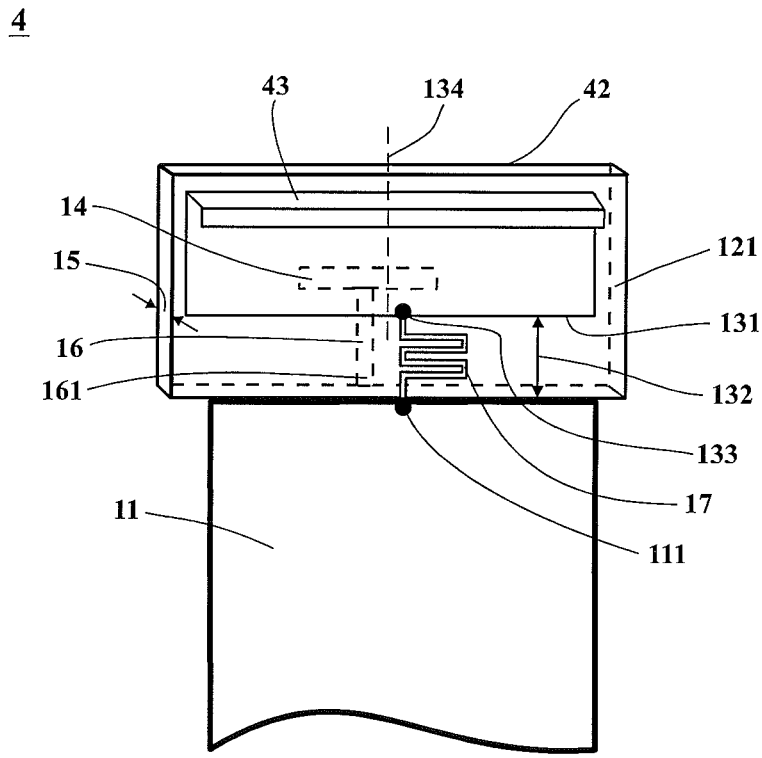
FIG. 4 illustrates a structural view of a mobile communication device in a third embodiment of the present invention.

FIG. 4 illustrates a structural view of a mobile communication device in a third embodiment of the present invention. The mobile communication device 4 has a ground plane 11 and an antenna 42. The antenna 42 is disposed on a dielectric substrate 121. The antenna 42 comprises a radiating metal portion 43, a coupling metal portion 14, and a shorting metal portion 17.

The radiating metal portion 43 is a three-dimensional structure after being bent twice. Except for the radiating metal portion 43, other elements disclosed in the third embodiment are similar to those disclosed in the first embodiment. After the radiating metal portion 43 is bent, the size of the antenna 42 can be reduced to achieve the object of antenna size miniaturization. The third embodiment can also achieve results similar to those which the first embodiment does.

Figure 5:
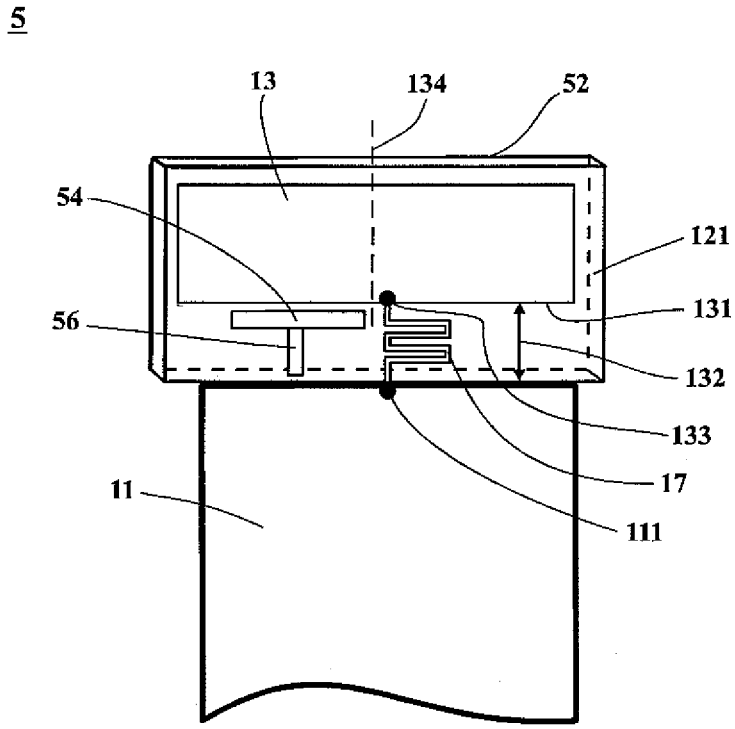
FIG. 5 illustrates a structural view of a mobile communication device in a fourth embodiment of the present invention.

FIG. 5 illustrates a structural view of a mobile communication device in a fourth embodiment of the present invention. The mobile communication device 5 has a ground plane 11 and an antenna 52. The antenna 52 is disposed on a dielectric substrate 121. The antenna 52 comprises a radiating metal portion 13, a coupling metal portion 54, and a shorting metal portion 17.

The coupling metal portion 54, a connecting metal strip 56, and the radiating metal portion 13 are disposed on the same surface of the dielectric substrate 121. Except for the coupling metal portion 54, other elements disclosed in the fourth embodiment are similar to those disclosed in the first embodiment. Because of the uni-planar structure of the antenna 52, the antenna 52 can be manufactured by one-time printing or etching, to facilitate the manufacturing process. The fourth embodiment can also achieve results similar to those which the first embodiment does.

Figure 6:
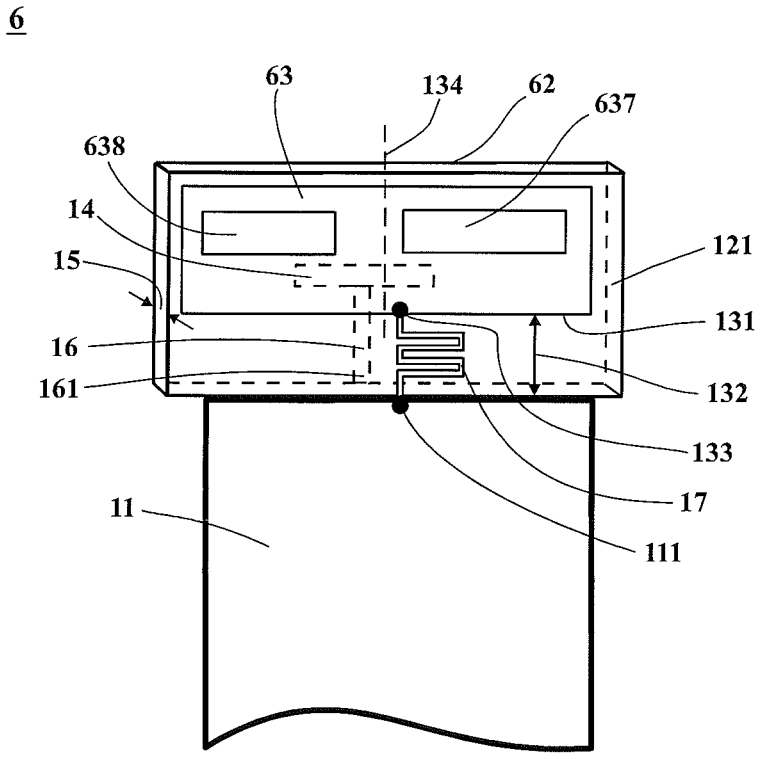
FIG. 6 illustrates a structural view of a mobile communication device in a fifth embodiment of the present invention.

FIG. 6 illustrates a structural view of a mobile communication device in a fifth embodiment of the present invention. The mobile communication device 6 has a ground plane 11 and an antenna 62. The antenna 62 is disposed on a dielectric substrate 121. The antenna 62 comprises a radiating metal portion 63, a coupling metal portion 14, and a shorting metal portion 17.

The radiating metal portion 63 comprises at least one slot. In this embodiment, the radiating metal portion 63 comprises two slots 637 and 638. Except for the radiating metal portion 63, other elements disclosed in the fifth embodiment are similar to those disclosed in the first embodiment. Because the radiating metal portion 63 is a wider metal portion, the surface current distribution of its interior is comparably weaker than that of the region near the edge 131 of the radiating metal portion 63. Therefore, with the presence of the slots 637 and 638, the surface currents excited by the antenna 62 will be influenced by the slots 637 and 638 in a comparably slighter way. Meanwhile, the fifth embodiment can also achieve results similar to those which the first embodiment does.

According to the abovementioned description, the antenna of the mobile communication device of the present invention transmits electromagnetic energy from the coupling metal portion to the radiating metal portion via the coupling gap by coupled feeding. The width of the radiating metal portion is at least one-eighth of its length. As a result, by the coupled feeding excitation, the antenna can generate the second (high-frequency) band capable of meeting the operating bandwidth (about 1 GHz) for the 5-band GSM1800/1900/UMTS/LTE2300/LTE2500 operations.

The distance between the shorting point of the radiating metal portion and the central line of the radiating metal portion is less than 15 mm. The distance between the connecting metal strip and the central line of the radiating metal portion is less than 15 mm. That is, the shorting point and the connecting metal strip should be approximately positioned close to the central line of the radiating metal portion, and preferably, the closer the better. Meanwhile, with the design of the radiating metal portion having a wider width (which is at least one-eighth of its length), the antenna can generate the first (low-frequency) band at about 850 MHz. Further, considering that the shorting metal portion has a chip inductor or the length of the shorting metal portion is at least 2 times the distance between the radiating metal portion and the ground plane, sufficient inductance for the input impedance of the antenna can be provided to compensate for the large capacitance of the input impedance of the original antenna. Thus, the operating bandwidth of the first (low-frequency) band can be significantly improved, thereby meeting the bandwidth (about 270 MHz) for the 3-band LTE700/GSM850/900 operations.

Therefore, the antenna of the mobile communication device of the present invention is equipped with the wide-band characteristic at both a low-frequency band and a high-frequency band, and its bandwidths can cover all of the 8-band LTE/GSM/UMTS operations. Further, the antenna is characterized by its small size (wherein the surface area of the antenna is 40×20 $mm^2$ or even smaller when the antenna is disposed on a system circuit board of a mobile communication device), suitable to be applied in a modern mobile communication device.

It is noted that the above-mentioned embodiments are only for illustration. It is intended that the present invention covers modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A mobile communication device having a ground plane and an antenna, wherein the antenna is disposed on a dielectric substrate, wherein the dielectric substrate has a first surface and a second surface opposite to the first surface, with a thickness defined between the first and second surfaces, with the antenna comprising:

a radiating metal portion located on the first surface, with the radiating metal portion being in a rectangular shape having a width and a length, wherein the width is at least one-eighth of the length, wherein an edge of the radiating metal portion faces the ground plane and has a distance between the edge and the ground plane, wherein the edge has a shorting point, wherein a central line of the radiating metal portion intersects the center of the length and is substantially perpendicular to the length, and wherein the distance between the shorting point and the central line of the radiating metal portion is less than 15 mm;

a coupling metal portion located on the second surface, with the coupling metal portion overlapping the rectangular shape of the radiating metal portion and coupling electromagnetic energy to the radiating metal portion via a coupling gap defined by the thickness, wherein the coupling metal portion is electrically connected to a source via a connecting metal strip substantially parallel to the central line, and wherein the distance between the connecting metal strip and the central line of the radiating metal portion is less than 15 mm; and a shorting metal portion having one end electrically connected to the radiating metal portion and another end electrically connected to the ground plane, wherein the length of the shorting metal portion is at least 2 times of the distance between the radiating metal portion and the ground plane.

2. The mobile communication device as claimed in claim 1, wherein a line width of the shorting metal portion of the antenna is less than 1 mm.

3. The mobile communication device as claimed in claim 1, wherein the radiating metal portion of the antenna is bent at least once to protrude from the first surface to form a three-dimensional structure.

4. The mobile communication device as claimed in claim 1, wherein operating bandwidths of the antenna cover 698~960 MHz and 1710~2170 MHz.

5. The mobile communication device as claimed in claim 1, wherein the radiating metal portion comprises at least one slot spaced from and inside edges of the rectangular shape.

6. An antenna used in a mobile communication device having a ground plane, wherein the antenna is disposed on a dielectric substrate, wherein the dielectric substrate has a first surface and a second surface opposite to the first surface, with a thickness defined between the first and second surfaces, with the antenna comprising:

a radiating metal portion located on the first surface, with the radiating metal portion being in a rectangular shape having a width and a length, wherein the width is at least one-eighth of the length, wherein one edge of the radiating metal portion faces the ground plane and has a distance between the edge and the ground plane, wherein the edge has a shorting point, wherein a central line of the radiating metal portion intersects the center of the length and is substantially perpendicular to the length, and wherein the distance between the shorting point and the central line of the radiating metal portion is less than 15 mm;

a coupling metal portion located on the second surface, with the coupling metal portion overlapping the rectangular shape of the radiating metal portion and coupling electromagnetic energy to the radiating metal portion via a coupling gap defined by the thickness, wherein the coupling metal portion is electrically connected to a source via a connecting metal strip substantially parallel to the central line, and wherein the distance between the connecting metal strip and the central line of the radiating metal portion is less than 15 mm; and a shorting metal portion having one end electrically connected to the radiating metal portion and another end electrically connected to the ground plane, wherein the length of the shorting metal portion is at least 2 times the distance between the radiating metal portion and the ground plane.

7. A mobile communication device having a ground plane and an antenna, wherein the antenna is disposed on a dielectric substrate, wherein the dielectric substrate has a first surface and a second surface opposite to the first surface, with a thickness defined between the first and second surfaces, with the antenna comprising:

a radiating metal portion located on the first surface, with the radiating metal portion being in a rectangular shape having a width and a length, wherein the width is at least one-eighth of the length, wherein an edge of the radiating metal portion faces the ground plane and has a distance between the edge and the ground plane, wherein the edge has a shorting point, wherein a central line of the radiating metal portion intersects the center of the length and is substantially perpendicular to the length, and wherein the distance between the shorting point and the central line of the radiating metal portion is less than 15 mm;

a coupling metal portion located on the second surface, with the coupling metal portion overlapping the rectangular shape of the radiating metal portion and coupling electromagnetic energy to the radiating metal portion via a coupling gap defined by the thickness, wherein the coupling metal portion is electrically connected to a source via a connecting metal strip substantially parallel to the central line, and wherein the distance between the connecting metal strip and the central line of the radiating metal portion is less than 15 mm; and a shorting metal portion having one end electrically connected to the radiating metal portion and another end electrically connected to the ground plane, wherein the shorting metal portion is connected in series with a chip inductor.

* * * * *